US005835051A

United States Patent [19]

Bannasch et al.

[11] Patent Number: 5,835,051

[45] Date of Patent: Nov. 10, 1998

[54] METHOD FOR OFFERING A PHANTOM TARGET

[75] Inventors: Heinz Bannasch; Martin Fegg, both of Schoenau; Fritz Greindl, Bad Reichenhall; Johannes Grundler, Neuenburg/Baden; Guenther Lenniger, Bad Reichenhall; Helmut Proeschkowitz, Ruhpolding; Rudolf Salzeder, Piding; Martin Wegscheider, Bayerisch Gmain, all of Germany

[73] Assignee: Buck Werke GmbH & Co., Bad Ueberkingen, Germany

[21] Appl. No.: 839,919

[22] Filed: Apr. 21, 1997

[30] Foreign Application Priority Data

May 3, 1996 [DE] Germany ..... 196 17 701.4

[51] Int. Cl.[6] ..... F42B 12/70

[52] U.S. Cl. ..... 342/12

[58] Field of Search ..... 342/12, 9, 5; 102/505

[56] References Cited

U.S. PATENT DOCUMENTS

| | | | |
|---|---|---|---|
| 4,183,302 | 1/1980 | Schillreff | 342/12 |
| 4,222,306 | 9/1980 | Maury | 102/505 |
| 4,860,657 | 8/1989 | Steinick et al. | 102/505 |
| 5,499,582 | 3/1996 | Schiessl | 102/505 |

FOREIGN PATENT DOCUMENTS

| | | |
|---|---|---|
| 0 029 078 A1 | 5/1981 | European Pat. Off. . |
| 0 055 139 A1 | 6/1982 | European Pat. Off. . |
| 0 086 708 A1 | 8/1983 | European Pat. Off. . |
| 26 38 920 A1 | 3/1978 | Germany . |
| 30 48 595 A1 | 7/1982 | Germany . |
| 34 03 936 A1 | 8/1985 | Germany . |
| 38 35 887 A1 | 5/1990 | Germany . |

*Primary Examiner*—Daniel T. Pihulic
*Attorney, Agent, or Firm*—Hill & Simpson

[57] ABSTRACT

The method offers a phantom target for protecting land, air or water craft or the like against missiles that have a target seeking head operating in the infrared (IR) or radar (RF) range or simultaneously or serially in both wavelength ranges. A mass emitting radiation in the IR range (IR active mass) and a mass back-scattering RF radiation (RF active mass) are simultaneously brought into action in the correct position as phantom target.

39 Claims, 4 Drawing Sheets

METHOD FOR OFFERING A PHANTOM TARGET

BACKGROUND OF THE INVENTION

The present invention is directed to a method for offering a phantom target for protection of land, air or water craft or the like against missiles having a target searching head that operates in the infrared (IR) or radar (RF) range or in both wavelength ranges simultaneously or serially. Information regarding modern, autonomously operating missiles will clearly increase since missiles even with the most modern target searching systems are becoming wide-spread due to the collapse of the former superpower of the Soviet Union as well as due to liberal export regulation, particularly of Asiatic countries. The target seeking systems of such missiles work mainly in the radar range (RF) and in the infrared range (IR). Both the radar back-scatter behavior as well as the emission of specific infrared radiation from targets such as, for example, ships, aircraft, tanks, etc., are thereby used for target finding and target tracking. Developments in modern missiles are clearly proceeding in the direction of multi-spectral target seeking systems that work simultaneously or serially in the radar and infrared range in order to be able to implement an improved spurious target discrimination. Multi-spectral IR target seeking heads work with two detectors that are sensitive in the short-wave and long-wave infrared range for spurious target discrimination. What are referred to as dual mode target seeking heads operate in the radar and in the infrared range. Missiles with such target seeking heads are radar-controlled in the approach and seek phase and switch to an infrared seek head in the tracking phase. One target criterion of dual mode target seeking heads is the co-location of the radar range back-scatter and of the infrared center of radiation. Spurious targets (for example clutter such as older types of phantom bodies) can be better separated on the basis of the possible comparison of target coordinates. The co-location of radar range and infrared effectiveness is consequently a compulsory pre-requisite for a dual mode phantom member in order to effectively fool modern dual mode target seeking heads, that is in order to steer them from an object to be protected onto a phantom target. Only the smallest possible resolution cell of the target seeking head (RF and IR) is thereby relevant for the co-location.

SUMMARY OF THE INVENTION

It is an object of the present invention to provide a method for offering a phantom target available with which both IR-guided and RF-guided as well as dual-mode-guided missiles can be diverted from the actual target, that is from the object to be protected, and steered onto a phantom target.

This object is inventively achieved in that a mass that emits radiation in the IR range (IR active mask) and a mass back-scattering RF radiation (RF active mass) are simultaneously brought into effect in the correct position as phantom target.

It can thereby be provided that the active masses are positioned by a projectile placed in rotation without a shell casing surrounding the active masses.

Advantageously, the active masses are activated and distributed with an activation and distribution means. In particular, it can thereby be provided that an ignition and blow-out unit centrally arranged in the projectile is employed as activation and distribution means.

A pyrotechnic charge can also be employed for ignition and blow-out, this being triggered by an ignition delay means that is fired by the burn-out of a propulsion charge for the projectile.

Beneficially, the pyrotechnic charge for the ignition and blow-out unit is burned off within a tube that is arranged centrally in the projectile and is provided with defined blow-out openings.

Active masses can also be employed that are arranged in the projectile in longitudinal direction thereof.

The RF active mass is thereby beneficially employed that has its generated surface surrounded by a paper, cardboard or plastic foil envelope.

It can also be alternatively provided that the active masses are positioned by a projectile placed in rotation and having a shell casing surrounding the active masses.

It can thereby be provided that the active masses, including an activation and distribution means, are ejected from the shell casing in common during the flight phase of the projectile with an ejection part and are subsequently activated and distributed. What is thereby achieved given a projectile with a shell casing surrounding the active masses is that the active masses are distributed without being blocked up and, thus, an excess pressure does not influence the active masses in the distribution of the active masses. Accordingly, the distribution of the IR active mass and, in particular, the distribution of the RF active mass can be improved in a long-lasting way. Moreover, the activation of the IR active mass is clearly improved, as a result whereof the effectiveness of the IR active mass with respect to the radiation intensity per volume unit as well as with respect to the emitting area increases compared to methods without ejection of the active masses.

It can thereby be provided that a propulsion charge is employed for the ejection of the ejection part, this propulsion charge being fired by a detonation delay means that is ignited by the burn-off of an ejection propulsion charge for the projectile.

The ejection propulsion charge for the ejection part is preferably ignited with a pyrotechnic detonation delay means.

Beneficially, a detonation blow-out unit centrally arranged in the ejection part is employed as activation and distribution means for the activation and distribution of the IR active mass as well as for the distribution of the RF active mass.

It can thereby be provided that a pyrotechnic charge is employed for detonation and blow-out, this pyrotechnic charge being ignited by a detonation delay means that is ignited by the burn-out of the ejection propulsion charge for the ejection part.

It can also be provided that the detonation delay means is ignited when the effective masses are ejected from a casing.

Beneficially, the pyrotechnic charge of the ignition and blow-out unit is burned off within a pipe centrally arranged in the ejection part and provided with defined blow-out openings.

It can also be provided that active masses are employed that are successively arranged in the ejection part in longitudinal direction of the ejection part.

It can also be provided that a RF active mass is employed that has its generated surface surrounded by an aluminum, paper, cardboard or plastic foil envelope.

Aluminum potassium per chlorate or magnesium barium nitrate is preferably employed as pyrotechnic charge.

Active masses are preferably employed that are annularly arranged around the ignition and blow-out unit.

Advantageously, the ignition and blow-out charge is employed in an amount matched such to the plurality and to the cross-section of the blow-out openings employed that greater accelerating forces do not act on the active masses. The quantity of ignition and blow-out charge in relationship to the plurality and the cross-section of the blow-out openings, namely, defines the speed with which the ignition and blow-off charge is burned off. Given the same charge amount, the burn-off speed increases with the decrease of the overall cross-section of the blow-out openings. The inventive quantity selection for the ignition and blow-off charge assures that no abrupt pulse corresponding to an explosion is exerted on the active masses instead of a uniform thrust. An improved firing and distribution of the RF active masses as well as an improved distribution of the RF active mass compared to traditional explosion principles is thus assured. The improved firing and distribution of the active masses in turn leads to an improved performance yield of the active masses employed.

According to a specific embodiment of the invention, it can be provided that the projectile is placed into rotation by a rotation motor. In particular, it can thereby be provided that the projectile is placed in rotation by a pyrotechnic rotation motor.

On the other hand, it can also be provided that the projectile is placed into rotation on the basis of appropriately fashioned flues in the shell cup. It can also be provided that the projectile is placed into rotation by appropriately fashioned air baffle surfaces of the projectile.

It can also be provided that a projectile having a caliber in the range from about 10–155 mm is employed.

In another, specific embodiment of the invention, rolled-up radar dipoles of aluminum-coated or silver-coated fiberglass threads having a thickness in the range from about 10–100 $\mu$m are employed as RF active mass. Such dipoles have a high scattering capability in the radar wave range according to antenna laws as well as the Mie law. Over and above this, they distribute excellently in air and also exhibit good quotation capability.

Beneficially, dipoles having a dipole length that corresponds to half the anticipated radar wavelength $\lambda$ multiplied by the refractive index n of the air are employed, that is the dipole length is matched, among other things, to the radar wavelength $\lambda$ of the anticipated target-seeking head.

Beneficially, the dipoles are employed in a plurality of more than one million per kilogram.

Advantageously, dipole packets are employed that are arranged such they open immediately when blown out.

According to another, especially advantageous embodiment, dipole packets are employed that are protected against the blow-out heat by at least one heat shield.

In particular, it can be provided that at least one foil that extends through the entire RF active mass is respectively employed as heat shield or shields.

It can also be provided that a heat-resistant, elastic foil is respectively employed as heat shield or shields.

According to another particular embodiment of the invention, dipole packets are employed at, for protecting them from sliding into one another, are respectively separated from one another by at least one heat-resistant foil.

It can also be provided that an IR active mass with flares having center-wave radiation part (MWIR flares) is employed.

It can particularly be provided that MWIR flares according to German Letters Patent 43 27 976 are employed.

Finally, it can be provided that an RF active mass is employed whose share in the overall active mass amounts to more than 50%. This has proven especially advantageous on the basis of trials.

The invention is based on the surprising perception that an effective phantom target that not only steers dual mode target-seeking heads but also target-seeking heads that were at only one wavelength range (IR or, respectively, RF range) from an object to be protected is offered by a simultaneous employment of an RI and a RF active mass that are activated simultaneously and at the same location (co-location). A phantom member that works according to the inventive method thus enables the simultaneous diversion with mixed attacks of IR-guided and RF-guided missiles and of dual-mode-guided missiles. When, according to a particular embodiment of the invention, the projectile is placed into rotation, this leads, first, thereto that the projectile is stabilized on its flight path and, second, also leads thereto that an effective turbulence and laying of the active masses is guaranteed by the centrifugal force when the target location is reached. This is directly possible insofar as the active masses are fired without a shell casing surrounding them. Insofar as, however, the active masses are fired with a shell casing surrounding them, a similarly good three-dimensional distribution in the air is achieved by the particular embodiment of the method wherein the active masses are ejected from the shell casing together with the activation and distribution means and are only subsequently activated and distributed.

BRIEF DESCRIPTION OF THE DRAWINGS

The features of the present invention which are believed to be novel ,are set forth with particularity in the appended claims. The invention, together with further objects and advantages, may best be understood by reference to the following description taken in conjunction with the accompanying drawing, in which:

DESCRIPTION OF THE PREFERRED EMBODIMENTS

Figure 1:
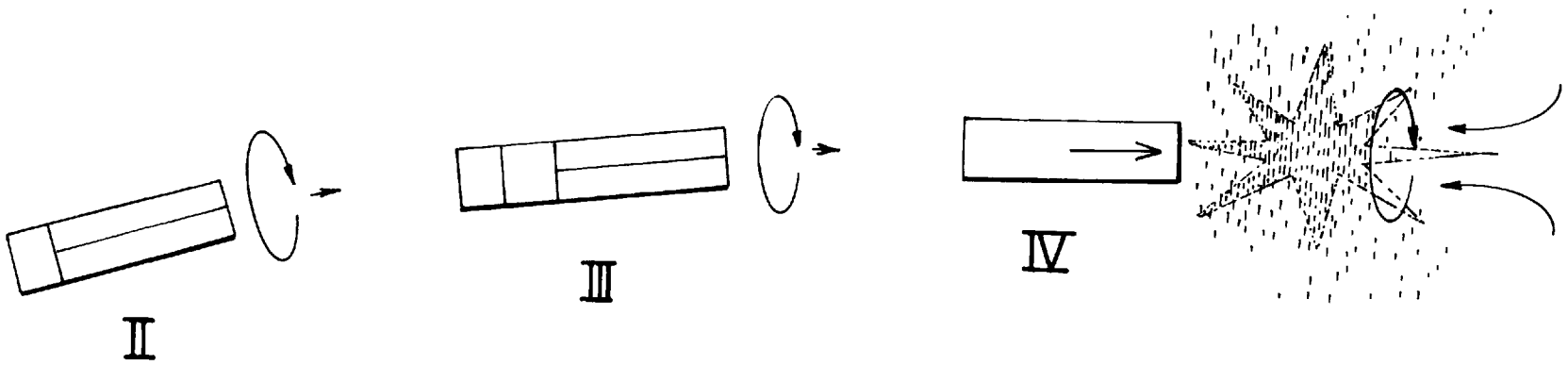
FIG. 1 is a schematic diagram of an embodiment of the inventive method.

FIG. 1 illustrates the fundamental method execution according to a specific embodiment of the present invention. The inventive method can be presented best in terms of the time sequence from the firing of a phantom member working according to the inventive method up to the distribution of the active masses. The time sequence can be roughly divided into four phases:

Phase I—Firing a phantom member

Phase II—Twist-stabilized flight phase of the phantom member.

Phase III—Ejection of the RR and RF active mass; and

Phase IV—Activation and distribution of the active masses.

FIG. 1 schematically shows Phases II–IV. The detonation and the firing according to Phase I proceeds according to the prior art. In Phase II, the phantom member comprises a twist-stabilized flight phase in order to make sure that the RF and IR active masses are flooded in a defined way. The rotational pulse is largely preserved until the active masses are distributed and is transmitted onto the active masses, this in turn resulting in an improved distribution of the active masses. In Phase III, the active masses including an activation and distribution mechanism are ejected from the shell casing of the disguised member during flight in order to achieve a subsequent distribution of the active masses without blocking, this providing the advantage that an excess pressure does not act on the active masses during the distribution of the active masses. This leads to the fact that the distribution of the IR active mass but, in particular, the distribution of the RF active mass is improved in a long-lasting way. In Phase IV, an effective distribution of the active masses is achieved by rotation and air flow as well as by a central blow-out.

Figure 2:
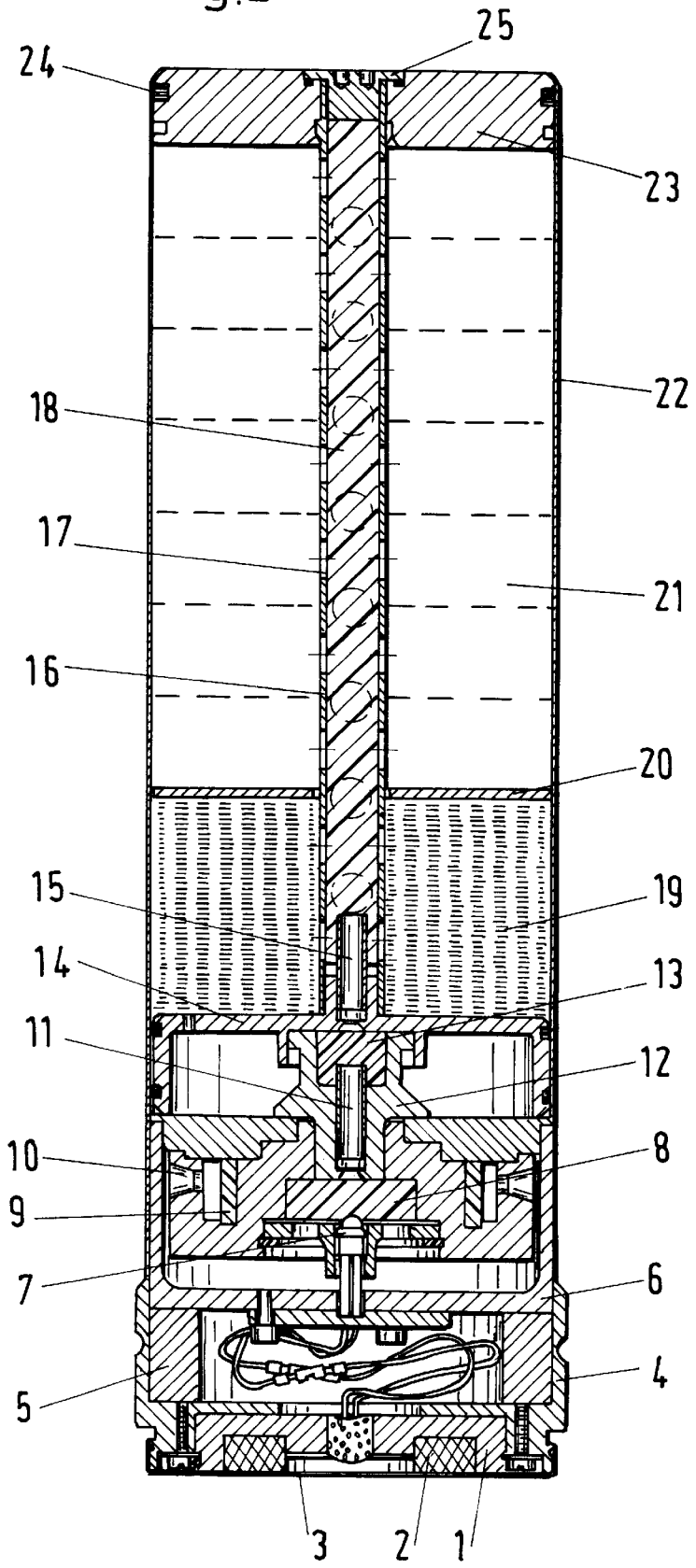
FIG. 2 is a sectional view of an embodiment of a phantom member working according to the inventive method.

FIG. 2 shows a longitudinal section through a phantom member that works according to the specific embodiment of the inventive method outlined in FIG. 1. A complete secondary part for inductive absorption of detonation energy from a primary part is referenced 1. The secondary part 1 is composed of magnetic material, preferably iron. The ignition energy is induced in a secondary coil 2. The windings of the secondary coil are composed of copper wire treated with insulating lacquer. The plurality of turns preferably corresponds to that of a primary coil, whereby, however, a transformation is fundamentally possible. A preferably beaded floor cover 3 serves as lower securing termination of the phantom member. The floor cover 3 is preferably composed of metal. Execution with glass-reinforced or carbon fiber-reinforced plastic, however, is also possible. The outer firing member is formed by a housing casing 4 that is preferably composed of pure aluminum with an aluminum part of more than 99%. The housing casing 4 remains in the magazine. A floor ring 5 creates a distance from a pressure chamber 6. The pressure chamber 6 accepts the propulsion gas that arises when a propulsion charge 8 is burned for ejecting the phantom member shell. Over and above this, the pressure chamber 6 is necessary in order to form a closed pressure space for igniting a rotation motor. The propulsion charge 8 is ignited with a firing charge 7 that is preferably composed of a powder drive unit, preferably black powder or drive units similar to black powder such as nitrocellulose powder.

Rotation charges 9 are preferably composed of compressed powder propellent with additional binder for mechanical stabilization such as, for example, black powder with plastic binder, or are composed of a commercially obtainable solid-state rocket fuel unit. Density, shape, surface and depth of the rotation charges 9 define the burning parameters such as burning duration and pulse/time unit. The specific pulse is determined by the selection of the drive unit. The rotation charges 9 are preferably fashioned fuel-like and are preferably pressed into combustion chambers (see reference numeral 10). This pressing-in of the rotation charges 9 mainly serves the purpose of stabilizing the burning behavior since the surfaces of the rotation charges 9 facing the metal and not the combustion chamber do not burn. There is also the possibility of controlling the burning behavior by a passivation of the surfaces. Another possibility for controlling the burning behavior is comprised of the known method of shaping such as, for example, star burner. The quantity of rotation charge 9 is dependent on the burning behavior and on the desired pulse/time behavior. A burning time of approximately 1.5 seconds was realized for this exemplary embodiment.

The reference numeral 10 identifies rotation jets including the aforementioned combustion chamber. The rotation jets are composed of a jet net and of a jet cone that are both preferably mulled or, respectively, drilled from a solid cast aluminum part. The jet cone preferably comprises a slope of approximately 10° through 20° from the jack axis. The length of the jet neck is preferably less than the length of the jet cone. The combustion chamber is preferably cylindrically fashioned. The combustion chambers are connected by an annular channel in order to achieve a pressure compensation that effects a uniform burning. The jet axis is slanted radially relative to the projectile. The jet axis should preferably slant by more than 30° relative to the radius of the projectile since the pulse would otherwise contribute only little to generating the rotation. Angles greater than 80° relative to the radius cause excessive turbulence at the transition from the combustion chamber to the jet neck and thus effect a deterioration of the thrust. A detonation delay means 11 serves the purpose of defining the flight distance up to the ejection of an IR active mass 19 and of a RF active mass 21. The detonation delay means 11 is pyrotechnically implemented and has a burning time of two seconds. Such detonation delay means are commercially obtainable. However, the employment of a freely programmable, electronic detonation delay means is also conceivable for variable definition of the flight time.

A connecting part 12 connects the rotation motor to an ejection part 14 for the active masses 19 and 21. The connecting part 12 contains the detonation delay means 11 and an ejection propulsion charge 13 for the ejection of the ejection part 14. The connecting part 12 is preferably fabricated of metal. The ejection propulsion charge 13 comprises a powder drive unit, preferably black powder or drive units similar to black powder such as nitrocellulose. The ejection part 14 serves as drive mirror for the ejection propulsion charge 13 and is executed such that it serves as holder for the detonation delay means 15 and for a blow-out pipe 16. The blow-out part 14 is preferably fabricated of a cast or milled aluminum part. The detonation delay means 15 comprises a pyrotechnic delay piece that ignites a detonation/resolver unit 18 when the ejection part 14 has left the shell casing. The detonation delay means 15 has a burning time of approximately 0.1 seconds. The blow-out pipe 16 serves as receptacle for the detonation/resolver unit 18 and for controlling the blow-out speed. The blow-out speed is dependent on the length of the blow-out pipe 16 and of the ratio of the overall cross-section of blow-out openings 17 to the quantity of detonation/resolver unit 18. It can be generally stated that the blow-out speed is all the higher the higher the quantity of detonation/resolver unit 18 and the smaller the overall cross-section of the blow-out openings 17. The relationship is preferably selected such in the exemplary embodiment that a blow-out time of 0.1 seconds is achieved. The blow-out pipe 16 must be fabricated such that no plastic deformation occurs insofar as possible during the blow-out event. In the exemplary embodiment, the blow-out pipe 16 was manufactured of steel. The blow-out openings 17 must be attached such that a uniform distribution of the RF and IR active masses 19 and 21 is achieved. This is preferably achieved such that respectively one blow-out opening 17 needs one layer of the RF active mass 21.

Figure 3:
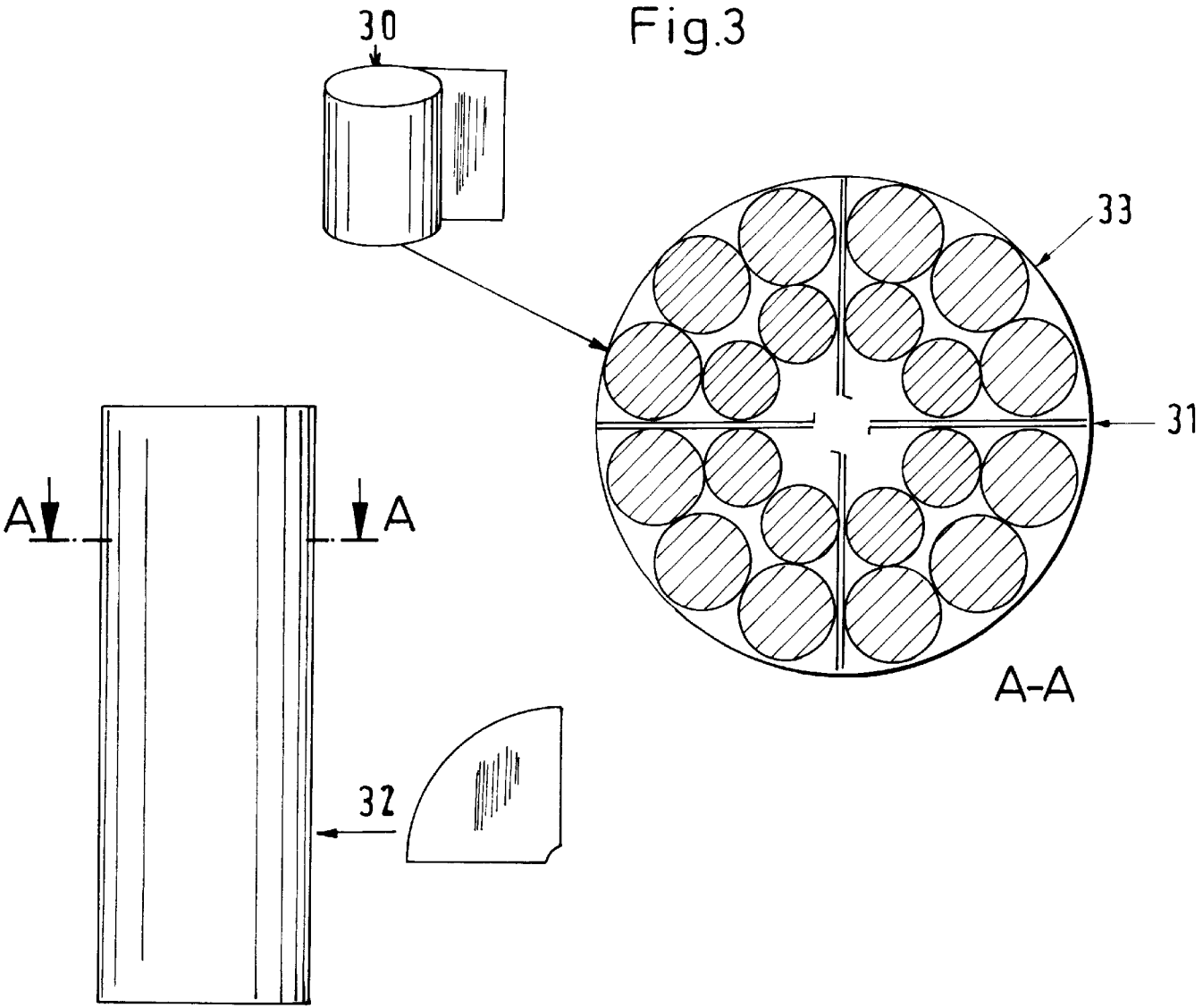
FIG. 3 is a schematic view of a RF active mass of the phantom member according to FIG. 2.

The detonation/resolver unit 18 comprises a pyrotechnic unit that delivers a comparatively great quantity of gas as combustion product. Magnesium barium nitrate or aluminum perchlorite of per chlorate are preferably employed for this purpose. The quantity of detonation/resolver unit 18 is dependent on the blow-out pipe 16. The IR active mass 19 contains the cap IR active mass with MWIR flares disclosed by German Patent 43 27 976. Fundamentally, however, all IR active masses can be employed that an be activated by a detonation charge. In the exemplary embodiment, disk-shaped MWIR flares with a ⅓ division are employed. A parting disc 20 protects the RF active mass 21 from the burning MWIR flares of the IR active mass 19. The parting disc 20 can be fabricated of metal or, preferably, of fire-resistant foil. The embodiment of the RF active mass 21 is shown in greater detail in FIG. 3. For reasons of heat protection, rolled-up radar dipoles with dipoles of aluminum-coated or silver-coated fiber glass threads having a thickness in the range from about 10–100 $\mu$m are employed as RF active mass 21. The dipole length amount to 17.9 mm. However, dipole lengths from about 1 mm to about 25 mm are also possible and provided. The plurality of wrappings of the individual dipole packets (chaff packets) is variable from one on up. 1.5 wrappings are preferably employed for the packets. The ejection of the active masses before the activation and distribution as well as the suitable "packaging" of the dipoles serves the purpose of avoiding a clumping and fusing and that of producing a spacing from dipole to dipole of about 7–10 $\lambda$ and, thus, a high radar back-scattered cross-section. The packaging must basically be flexible enough to automatically release the dipoles without external influence and in order to protect them against the influence of heat due to the detonation and blow-out charge. Moreover, the packaging of the dipoles is adapted to the distribution principle, i.e. the package dipoles are arranged such that they open immediately when blown out. Capton® or Milinex® are preferably employed as material for the wrappings and for the protective foils 31 and protective foils 32 going through entirely through the RF active mass to prevent dipoles from sliding into one another. Aluminum foils of various thicknesses can also be employed as intermediate foils 32. A thin aluminum envelope 33 that, however, can also be a paper or cardboard sheath, insures that the RF active mass 21 does not divide immediately after being ejected from the projectile shell but remains together until the detonation/resolver charge 18 has burned. It is thus assured that the overall energy of the charge can act on the RF active mass 21. A cover 23 serves the purpose of terminating a projectile casing 22 and fixes the blow-out pipe 16 from above. The cover 23 can be fabricated of heavy metals such as, for example, cast iron or brass in order to shift the center of gravity of the phantom member as far toward the front as possible. A stabilization of the flight can thereby be achieved envision to the rotation. The cover 23 is sealed from the projectile casing 22—which is preferably drawn from aluminum having a purity degree of more than 99%—by a seal ring 24. 25 represents a closure piece of the blow-out pipe 16 and assures that the relative dangerous resolver charge is introduced into the phantom member as last work step.

Figure 4:
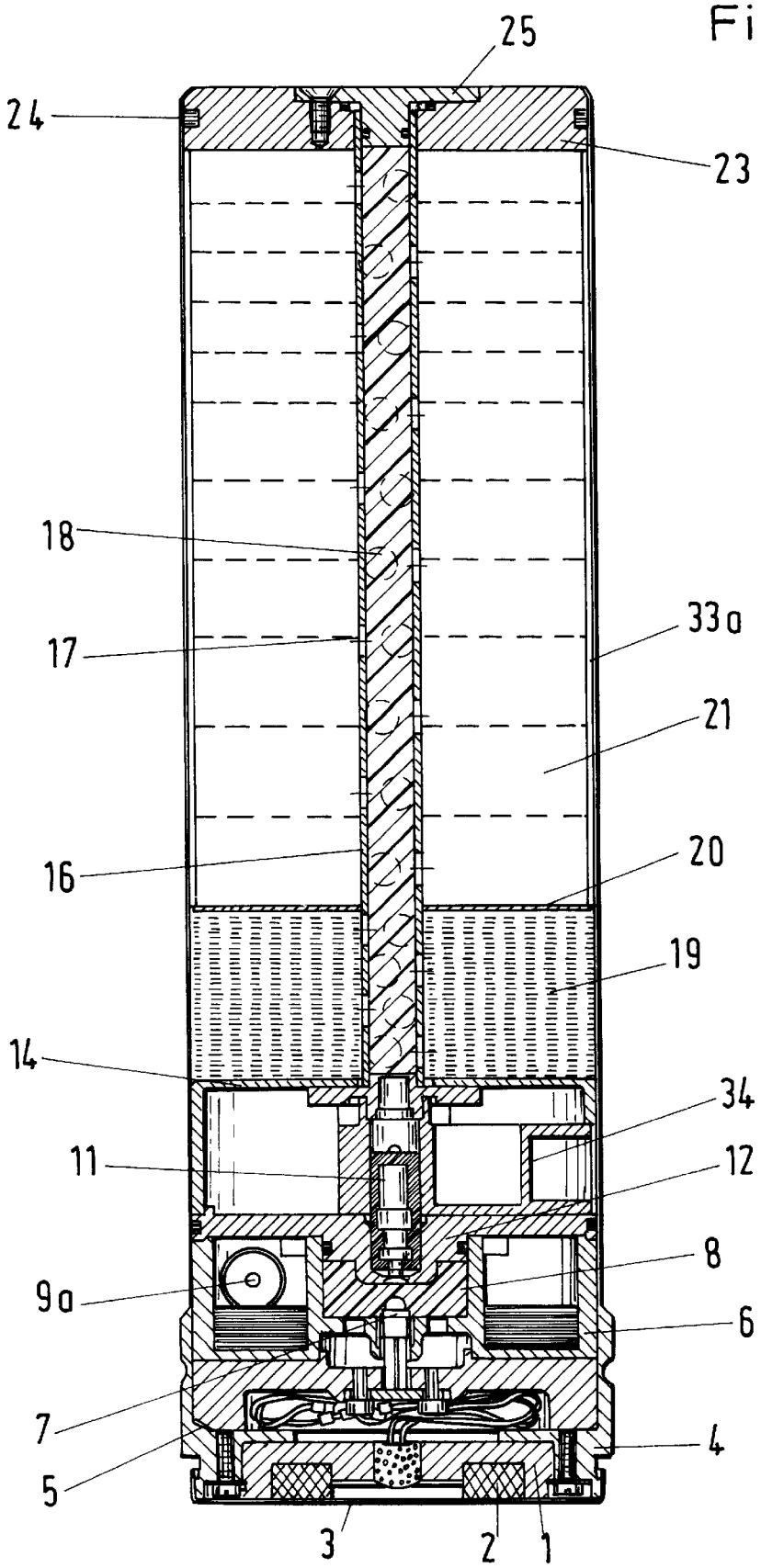
FIG. 4 is a sectional view of another embodiment of a phantom member working according to the present invention.

FIG. 4 shows another embodiment of a phantom member that functions according to a specific embodiment of the method. The same reference characters as in FIG. 2 are used in FIG. 4. Only the differences compared to the phantom member of FIG. 2 shall be discussed below. One critical difference is comprised therein that the projectile comprises no shell casing (identified with reference number 22 in FIG. 2). The IR active mass 19 and RF active mass 21 thus need not be ejected from the projectile casing before their activation and distribution and, thus, the ejection propulsion charge (identified with reference numeral 13 in FIG. 2) for the ejection part 14 as well as the detonation delay mean (identified with reference numeral 15 in FIG. 2) are no longer necessary and are therefore no longer present. The ejection part 14 also no longer serves the purpose of ejecting the active masses 19, 21 from the shell casing. The RF active mass 21 is surrounded by a paper or, respectively, cardboard sheath 33*a* instead of being surrounded by an aluminum sheath (reference number 33 in FIG. 3). This paper, or, respectively, cardboard envelope 33*a*, together with the central blow-out pipe 16, suffices to keep the RF active mass 21 together before the actual activation and distribution despite the air flow in the flight phase. A safety element 15 as disclosed, for example, by German Reference DE 19651974.8 sees to the pre-pipe safety. Further, the rotation charge (reference numeral 9 in FIG. 2) and rotation jet (reference numeral 10 in FIG. 2) are replaced by a rotation motor 9*a*. As a result of the lacking shell casing, the phantom member shown in FIG. 4 exhibits the advantage that it is simpler to manufacture and significantly less expensive compared to a phantom member having shell casing.

Both individually as well as an arbitrary combination, the features of the present invention disclosed in the above description, in the drawings as well as in the claims are important for realizing the various embodiments of the invention.

The invention is not limited to the particular details of the method depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claim is:

1. A method for offering via a projectile a phantom target for protecting land, air or water craft against missiles, comprising:

providing a target seeking head operating in at least one of an infrared range and radar range simultaneously or serially in both ranges;

simultaneously bringing into action in a correct position as phantom target a mass emitting radiation in the infrared range and a mass back-scattering radio-frequency radiation.

2. The method according to claim 1 wherein the method further comprises providing first and second active masses for the radiations infrared and radio-frequency ranges, respectively, and wherein the first and second active masses are positioned by a projectile placed in rotation without a shell casing surrounding the first and second active masses.

3. The method according to claim 2, wherein the active masses are activated and distributed by an activation and distribution device.

4. The method according to claim 3, wherein the activation and distribution device is a detonation and blow-out unit arranged centrally in the projectile.

5. The method according to claim 4, wherein a pyrotechnic charge that is detonated by a detonation delay means that is ignited by burn-off of a compulsion charge for the projectile is employed for detonation and blow-out.

6. The method according to claim 5, wherein the pyrotechnic charge for the detonation of blow-out unit is burned off within a pipe centrally arranged in the projectile and having defined blow-out openings.

7. The Method according to claim 2, wherein the first and second active masses are arranged following one another in longitudinal direction in the projectile.

8. The Method according to one of the claims 2 wherein the radio frequency active mass has a generated surface surrounded by one of a paper, cardboard and plastic foil envelope.

9. The Method according to claim 2, wherein the first and second active masses are positioned by a projectile placed in rotation and having a shell casing surrounding the first and second active masses.

10. The Method according to claim 9, wherein the first and second active masses, including an activation and distribution device, are ejected in common from the shell casing by an ejected part during a flight phase of the projectile and are subsequently activated and distributed.

11. The method according to claim 10, wherein a propulsion charge is employed for the ejection of the ejection part, said propulsion charge being ignited by a propulsion device that is ignited by the burning of an ejection propulsion charge for the projectile.

12. The method according to claim 11, wherein the ejection propulsion charge for the ejector part is ignited by a pyrotechnic detonation delay means.

13. The method according to claims 10, wherein a detonation and blow-out unit centrally arranged in the ejection part is employed as an activation and distribution device for activation and distribution of the infrared active mass as well as for distribution of the radio frequency active mass.

14. The Method according to claim 13, wherein a pyrotechnic charge is employed for the detonation and blow-out, said pyrotechnic charge being ignited by a detonation delay device that is ignited by burning of the ejection propulsion charge for the ejection charge.

15. The method according to claim 14, wherein the detonation delay device is ignited when the active masses are ejected from the casing.

16. The method according to claim 14 wherein the pyrotechnic charge of the detonation and blow-out unit is burned off within a pipe that is centrally arranged in the ejection part and that has defined blow-out openings.

17. The method according to claim 10, wherein the first and second active masses are employed that are arranged successively in the ejection part in longitudinal direction of the ejection part.

18. The method according to claim 9, wherein the first active mass is a radio frequency active mass that is surrounded on a generated surface thereof by one of an aluminum, paper, cardboard and plastic foil sheet.

19. The method according to claim 5 wherein aluminum potassium perchlorite or magnesium barium nitride is employed as pyrotechnic charge.

20. The method according to claim 2, wherein the first and second active masses are employed that are annularly arranged around a detonation and blow-out unit.

21. The method according to claim 5, wherein the detonation of blow-out charge is employed in a quantity matched to a plurality and to the cross-section of the employed bores such that no great accelerating forces act on the active masses.

22. The method according to claim 2, wherein the projectile is placed in rotation by a rotation motor.

23. The method according to claim 22, wherein the projectile placed in rotation by a pyrotechnic rotation motor.

24. The method according to claim 2, wherein the projectile is placed in rotation via flues in a shell cup.

25. The method according to one of the claim 2, wherein the projectile is placed in rotation by air baffle surfaces of the projectile.

26. The method according to claim 2, wherein a projectile having a caliber in a range from approximately 10–155 mm is employed.

27. The method according to claim 1, wherein rolled-up radar dipoles of one of aluminum-coated or silver-coated fiberglass threads having a thickness in the range from approximately 10–100 $\mu$m are employed as a radio frequency active mass.

28. The method according to claim 27, wherein dipoles having a predetermined dipole length are employed that corresponds to half an anticipated radar wavelength multiplied by a refractive index of air.

29. The method according to claim 27, wherein the dipoles are employed in a plurality of more than one million per kilogram.

30. The method according to claim 27, wherein dipole packets of dipoles are employed that are arranged such that the packets open substantially immediately when blown out.

31. The method according to one of the claim 27, wherein dipole packets of dipoles are employed that are protected against blow-out heat by at least one heat shield.

32. The method according to claim 31, wherein at least one foil that extends through the entire radio frequency active mass is respectively employed as at least one heat shield.

33. The method according to claim 32, wherein a heat-resistant, elastic foil is respectively employed as at least one heat shield.

34. The method according to claim 13, wherein dipole packets of dipoles are employed that are respectively separated from one another at least by a heat-resisting foil for protection against sliding into one another.

35. The method according to claim 1, wherein an infrared active mass is employed with layers having center-wavelength radiation devices.

36. The method according to claim 35, wherein MWIR flares are employed.

37. The method according to claim 1, wherein the infrared mass is less than 50% of a combined mass of the infrared mass and the radio-frequency mass.

38. The method according to claim 14, wherein aluminum potassium perchlorite or magnesium barium nitride is employed as pyrotechnic charge.

39. The method according to claim 14, wherein the detonation of blow-out charge is employed in a quantity matched to a plurality and to the cross-section of the employed bores such that no great accelerating forces act on the active masses.

* * * * *